US009960474B2

(12) United States Patent
Katipally et al.

(10) Patent No.: US 9,960,474 B2
(45) Date of Patent: May 1, 2018

(54) UNITARY ANTENNA DIPOLES AND RELATED METHODS

(71) Applicant: Radio Frequency Systems, Inc., Meriden, CT (US)

(72) Inventors: Raja Reddy Katipally, Chesire, CT (US); Aaron T. Rose, Hamden, CT (US)

(73) Assignee: Alcatel-Lucent Shanghai Bell Co. Ltd., Shanghai (CN)

( * ) Notice: Subject to any disclaimer, the term of this patent is extended or adjusted under 35 U.S.C. 154(b) by 1116 days.

(21) Appl. No.: 13/842,377

(22) Filed: Mar. 15, 2013

(65) Prior Publication Data

US 2014/0266952 A1 Sep. 18, 2014

(51) Int. Cl.

| | |
|---|---|
| ***H01Q 1/12*** | (2006.01) |
| ***H01Q 19/10*** | (2006.01) |
| ***H01Q 21/26*** | (2006.01) |
| ***H01Q 21/24*** | (2006.01) |
| ***H01Q 1/24*** | (2006.01) |
| ***H01Q 9/28*** | (2006.01) |

(52) U.S. Cl.

CPC ..... *H01Q 1/1207* (2013.01); *H01Q 1/246* (2013.01); *H01Q 9/28* (2013.01); *H01Q 9/285* (2013.01); *H01Q 19/108* (2013.01); *H01Q 21/24* (2013.01); *H01Q 21/26* (2013.01)

(58) Field of Classification Search

CPC ..... H01Q 9/28; H01Q 9/285; H01Q 1/1207; H01Q 1/246; H01Q 19/108; H01Q 21/26

See application file for complete search history.

(56) References Cited

U.S. PATENT DOCUMENTS

| | | | | |
|---|---|---|---|---|
| 2007/0080883 | A1* | 4/2007 | Boss | H01Q 9/06 343/797 |
| 2011/0298682 | A1* | 12/2011 | Plet | H01Q 1/246 343/797 |
| 2012/0081259 | A1* | 4/2012 | Regala | H01Q 21/26 343/797 |
| 2012/0235873 | A1* | 9/2012 | Wu et al. | 343/834 |

FOREIGN PATENT DOCUMENTS

| | | |
|---|---|---|
| FR | 2 939 569 A1 | 6/2010 |

* cited by examiner

*Primary Examiner* — Robert Karacsony
(74) *Attorney, Agent, or Firm* — The Capitol Patent & Trademark Law Firm, PLLC

(57) ABSTRACT

Unitary antenna dipole radiating elements are formed. Such elements include a base portion and a plurality of shaped arm portions unitarily formed on a side of the base portion. The antenna elements are configured to transmit and receive RF signals in a high frequency range.

17 Claims, 7 Drawing Sheets

(a)

(b)

(c)

(a)

(b)

UNITARY ANTENNA DIPOLES AND RELATED METHODS

BACKGROUND

Antennas which use high frequency antenna dipole radiating elements are commonly used in the telecommunications industry.

To manufacture a typical antenna dipole radiating element ("antenna element" for short) typically requires a number of different components to be formed and then connected together in accordance with specific tolerances in order to form a properly operating antenna element. This, in turn, requires a substantial amount of time and expense.

Accordingly, it is desirable to provide high-frequency antenna elements that require fewer components, but operate as well as, or better than typical antenna elements.

SUMMARY

Exemplary embodiments of unitary antenna dipoles and related methods are described herein. According to one embodiment a unitary high band dipole antenna element may comprise a base portion comprising a shaped central portion configured to be contacted to a chassis, and a plurality of shaped arm portions unitarily formed on a side of the base portion opposite the chassis and configured to transmit and receive RF signals in a high frequency range, each arm portion configured to comprise a plurality of slots in a volume pattern. Each arm portion may be further configured with the plurality of slots arranged in a fractal pattern and/or, configured with the plurality of slots arranged in a Sierpinski carpet pattern. Each arm portion may be further configured to receive at least a portion of a connecting cable.

In an additional embodiment, each of the plurality of shaped arm portions may be configured in a shape selected from the group consisting of a rectangular-shaped arm portion, triangle-shaped arm portion, star-shaped arm portion and fractal-shaped arm portion, to name just a few examples, or, alternatively two or more of the plurality of shaped arm portions may be configured in a same shape.

In a further embodiment the shaped central portion may be configured to be point contacted to a chassis, and, further may comprise a tubular inner portion having a shaped end portion that is configured to contact the chassis.

Still further, in accordance with additional embodiments antenna elements may be configured to operate in a frequency range of 1700 MHz to 2700 MHz or higher.

In addition to providing novel, unitary antenna elements the present invention provides for methods for forming unitary antenna elements.

For example, in one embodiment a method comprises forming a shaped antenna element body, forming a plurality of shaped arm portions in the body, forming a plurality of slots in the arm portions, and forming a plurality of connection openings in the body.

The method may further comprise additional steps, such as: formation of slots in a fractal pattern; formation of slots in a Sierpinski carpet pattern; forming a plurality of arm portions in a rectangular-shape, triangle-shape, star-shape and fractal-shape; and/or forming two or more of shaped arm portions in a same shape.

Still further, the method may comprise forming an antenna element to operate in a frequency range of 1700 MHz to 2700 MHz or higher.

Additional embodiments of the invention will be apparent from the following detailed description and appended drawings.

DETAILED DESCRIPTION, INCLUDING EXAMPLES

Figure 1:
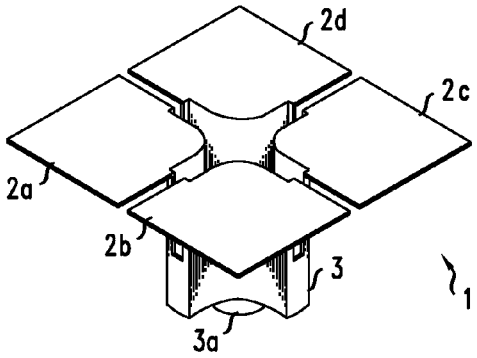
FIGS. 1(*a*) thru (*c*) depict exemplary views of an antenna element according to an embodiment of the invention.
Figure 1:
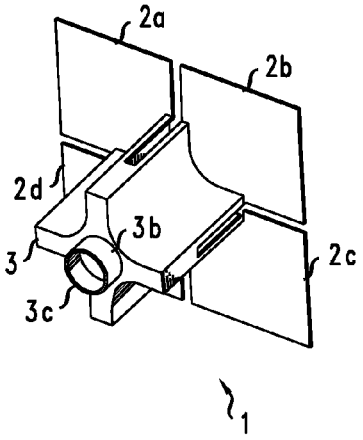
Figure 1:
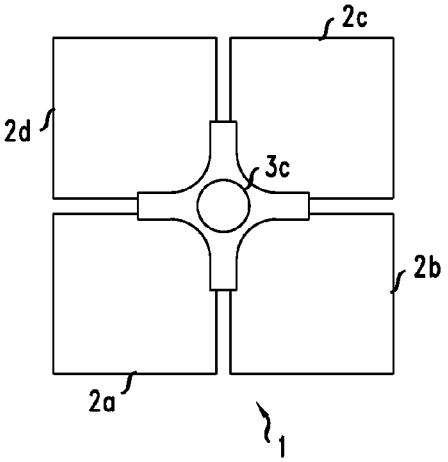

Exemplary embodiments of an antenna structure, components and related methods are described herein in detail and shown by way of example in the drawings. Throughout the following description and drawings, like reference numbers/characters refer to like elements.

It should be understood that, although specific exemplary embodiments are discussed herein there is no intent to limit the scope of present invention to such embodiments. To the contrary, it should be understood that the exemplary embodiments discussed herein are for illustrative purposes, and that modified, equivalent and alternative embodiments may be implemented without departing from the scope of the present invention.

Specific structural and functional details disclosed herein are merely representative for purposes of describing the exemplary embodiments. The inventions, however, may be embodied in many alternate forms and should not be construed as limited to only the embodiments set forth herein.

It should be noted that some exemplary embodiments may be described as processes or methods. Although the discussion herein may describe the processes/methods as sequential, the processes/methods may be performed in parallel, concurrently or simultaneously. In addition, the order of each step within a process/method may be re-arranged. A process/method may be terminated when completed, and may also include additional steps not discussed herein but known to those skilled in the art. The processes/methods may correspond to functions, procedures, subroutines, subprograms, etc., completed by an antenna element or component.

It should be understood that, although the terms first, second, etc. may be used herein to describe various antenna components, these components should not be limited by these terms. These terms are used merely to distinguish one component from another. For example, a first component could be termed a second component, or vice-versa, without departing from the scope of disclosed embodiments. As used herein, the term "and/or" includes any and all combinations of one or more of the associated listed items. It should be understood that if a component is referred to as being "connected" to another component it may be directly connected to the other component or intervening components may be present, unless otherwise specified. Other words used to describe connective or spatial relationships between components (e.g., "between," "adjacent," etc.) should be interpreted in a like fashion. As used herein, the singular forms "a," "an" and "the" are intended to include the plural forms as well, unless the context clearly indicates otherwise.

Unless specifically stated otherwise, or as is apparent from the discussion, the term "forming" refers to the action and processes of a machine used to form antenna elements including a computer system, or similar electronic computing device, that manipulates and transforms data represented as physical, electronic quantities within the computer system's registers and memories, for example, into other data similarly represented as physical quantities within the computer system's memories or registers or other such information storage, transmission or display devices. Unless specifically stated otherwise, or as is apparent from the discussion, the term "configuring" means at least the design of an antenna element that includes identified components, or the positioning of one or more such antenna components. Yet further the phrase "operable to" means at least having the capability of operating to complete, and/or is operating to complete, specified features, functions, process steps; or having the capability to meet desired characteristics, or meeting desired characteristics.

As used herein, the term "embodiment" refers to—an embodiment of the present invention—. Further, the phrase "base station" may describe, for example, a transceiver in communication with, and providing wireless resources to, mobile devices in a wireless communication network which may span multiple technology generations. As discussed herein, a base station includes the functionality typically associated with well-known base stations in addition to the capability to perform features, functions and methods related to the antenna structures discussed herein.

Figure 6:
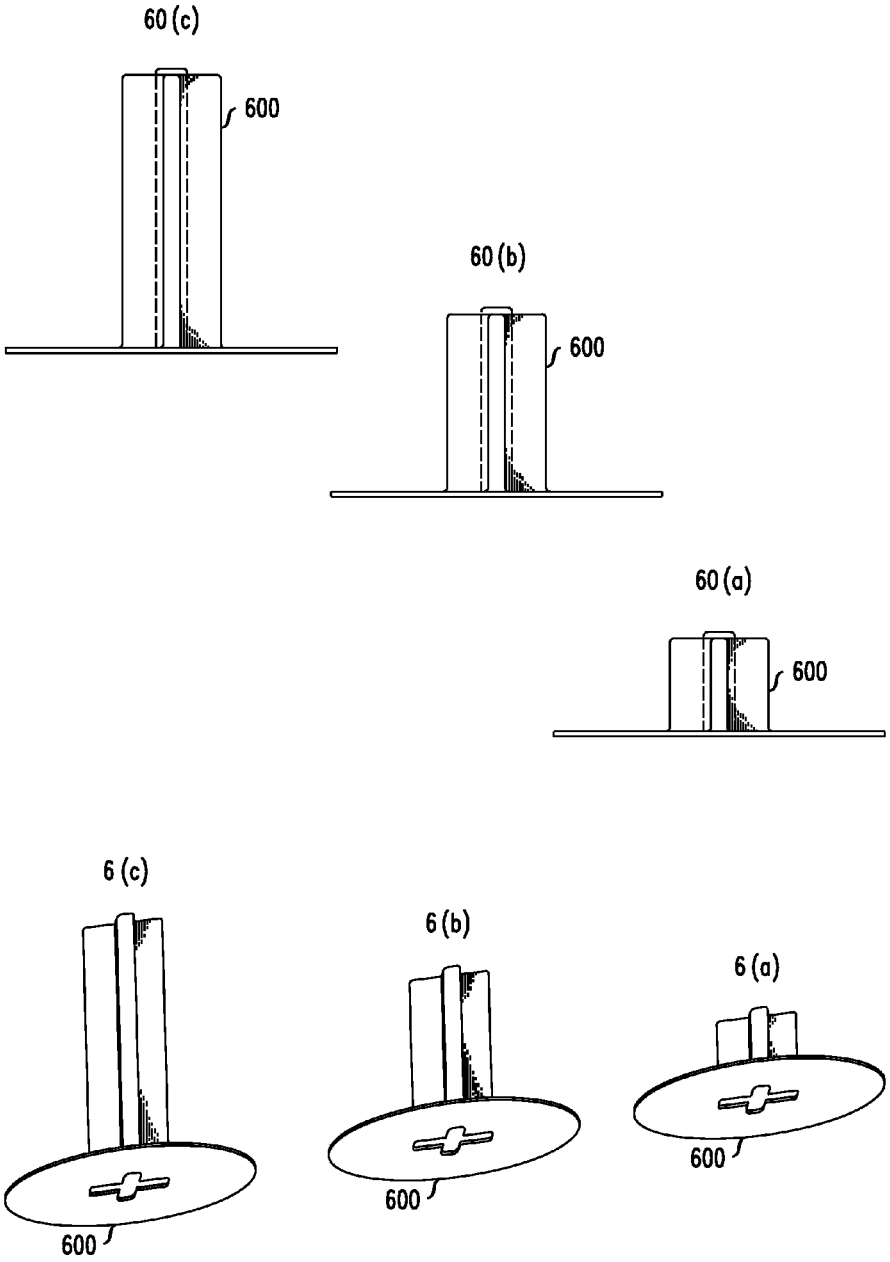
FIG. 6 illustrates a method for forming a body of a unitary antenna element according to an embodiment of the invention.
Figure 7:
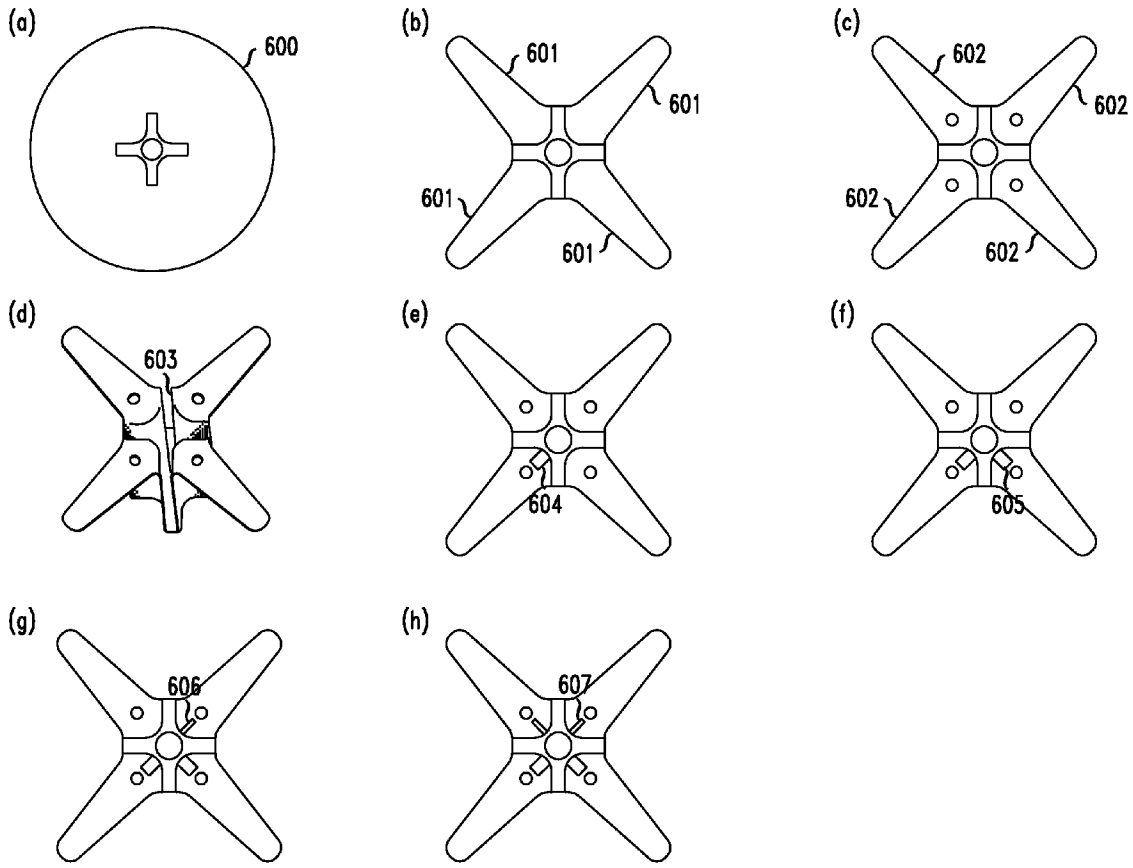
FIG. 7 illustrates a method for forming an antenna element according to embodiments of the invention.

FIGS. 1(*a*) thru (*c*) depict exemplary views of an antenna element 1 according to an embodiment of the invention. The antenna element 1 may be a part of, for example, a base station panel antenna for a mobile communication system. FIG. 1(*a*) depicts a side view, FIG. 1(*b*) a bottom view and FIG. 1(*c*) a top view of the element 1. Referring first to FIG. 1(*a*), in one embodiment of the invention the element 1 comprises a one-piece, unitary high band dipole antenna element that is made by iteratively applying a progressive die, for example, to a sheet of material. The material may be made from copper, bronze, aluminum, or any conductive alloy or plastic when a 3-dimensional printing process is used, for example. Yet further, the unitary antenna elements may be formed by molding, casting, or carving, for example. Once formed, an antenna element may be covered or plated, in part or in whole, with a metallic material that may be soldered, such as copper, silver, or gold. FIGS. 6 and 7 discussed herein provide a brief description of the techniques used to manufacture an exemplary antenna element.

Figure 5:
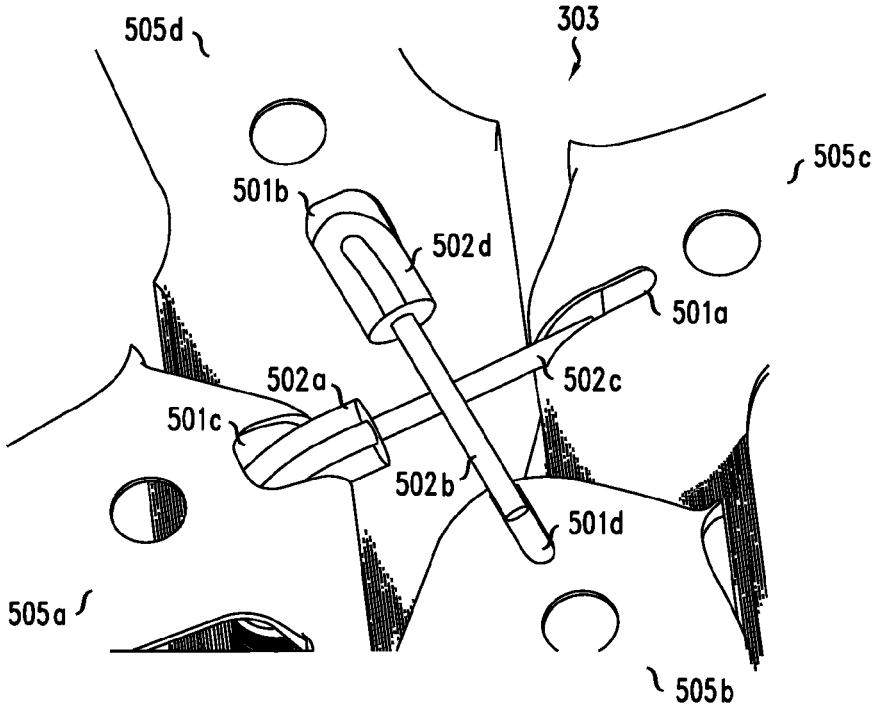
FIGS. 5(*a*) and (*b*) depict views of an antenna element configured to receive at least a portion of a connecting cable according to an embodiment of the invention.
Figure 5:
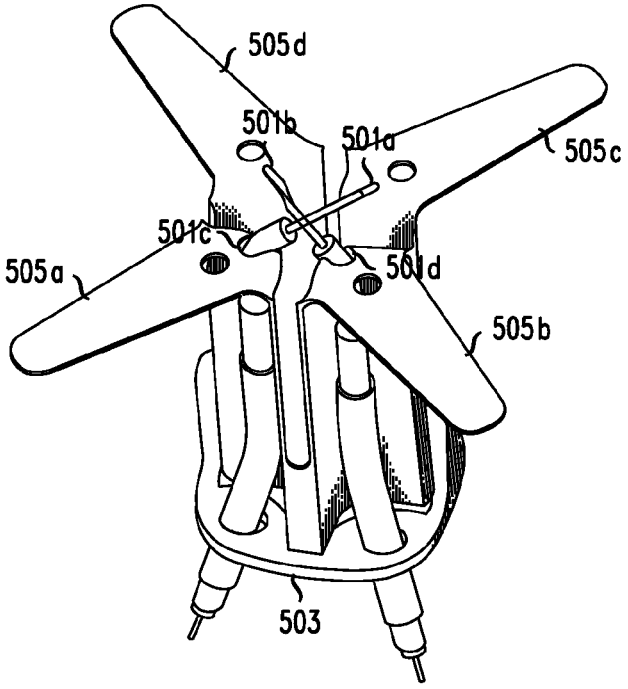

The unitary antenna element may comprise a number of unitary portions, among them are a base portion 3 and a plurality of shaped arm portions 2*a* through 2*d*. In an embodiment of the invention, the base portion 3 comprises a shaped central portion 3*a* configured to be contacted to a chassis or reflector plate (collectively referred to as "chassis" herein (chassis not shown in FIGS. 1(*a*) through (*c*), but see FIG. 5(*b*), component 503, for example). Together, the base portion and arm portions may be referred to as the "body" of the element 1.

In the embodiment depicted in FIGS. 1(*a*) through (*c*) the plurality of shaped arm portions 2*a* through 2*d* may be unitarily formed on a side of the base portion 3 opposite a chassis, and may be further configured to transmit and receive RF signals in a high frequency range (e.g., 1700 to 2700 megahertz (MHz) or higher). The shaped central portion 3*a* may be configured to be point contacted to the chassis, for example.

Referring to FIG. 1(*b*), in an embodiment of the invention the shaped central portion 3*a* may comprise a tubular inner portion 3*b* having a shaped end portion 3*c* (e.g., circular-shaped) that is configured to contact a chassis.

Figure 2:
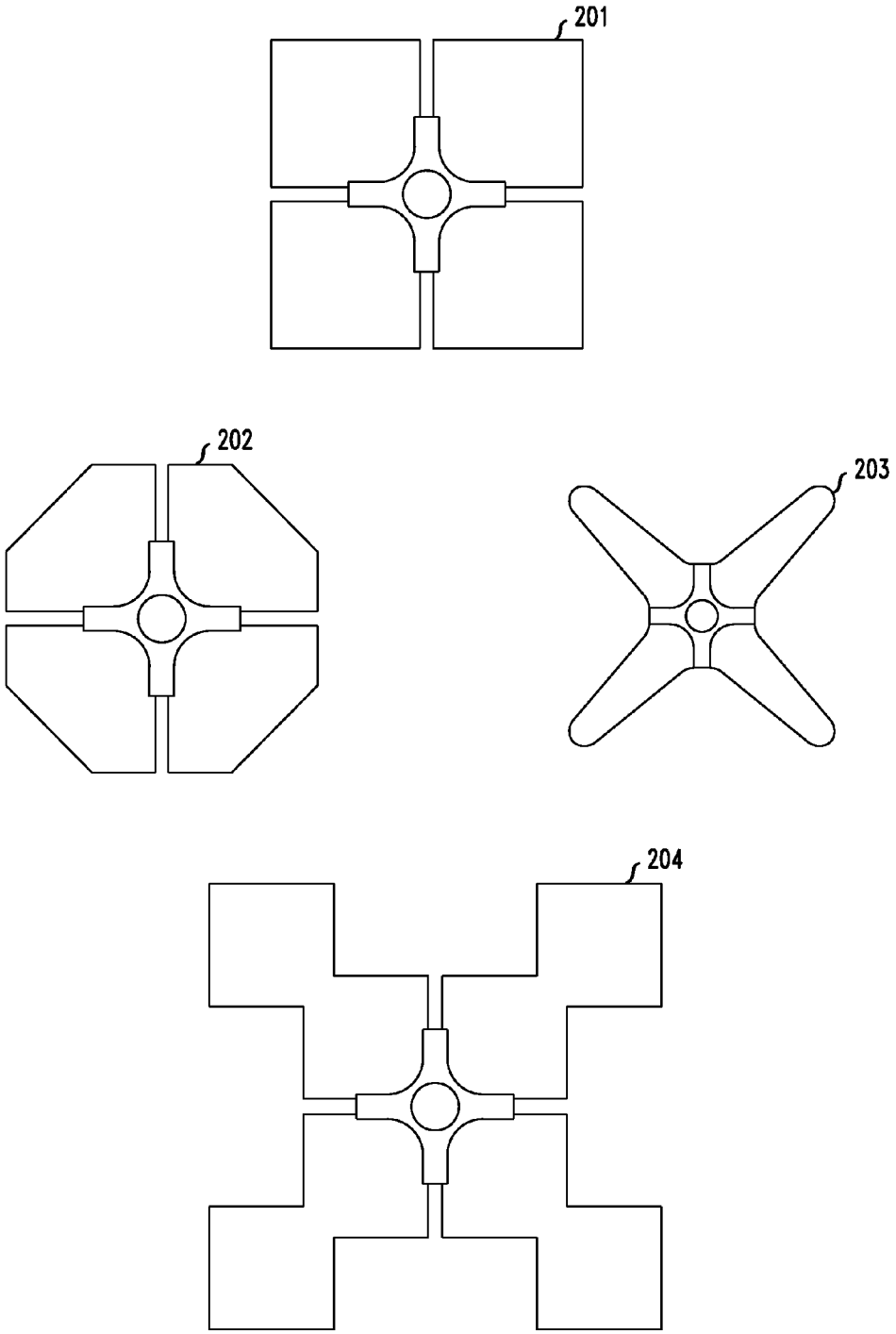
FIG. 2 depicts examples of shaped arm portions of antenna elements according to embodiments of the invention.

In the embodiment depicted in FIGS. 1(*a*) through (*c*) the plurality of shaped arm portions 2*a* through 2*d* are configured as rectangular-shaped arms (e.g., square-shaped arms). Referring to FIG. 2, in alternative embodiments of the invention each of the arms may be configured in a shape selected from the group consisting of at least a rectangular-shaped arm portion 201 (e.g., square or any rectangular shape), triangle-shaped arm portion 202, star-shaped arm portion 203, and fractal-shaped arm portion 204, to name just a few examples. Other shapes may be used as well without departing from the scope of the invention. The size and shape of the arm portions 201, 202, 203, 204 may vary from antenna to antenna and still be within the scope of the invention. Though each of the arm portions of each of the respective elements 201, 202, 203, 204 depicted in FIG. 2 is the same shape this may not always be the case. In alternative embodiments each of the arm portions may have a different shape, or two or more of the plurality of shaped arm portions may be configured in a same or different shape (i.e., one, two or three of the portions of an antenna element may have the same or different shape).

Figure 3:
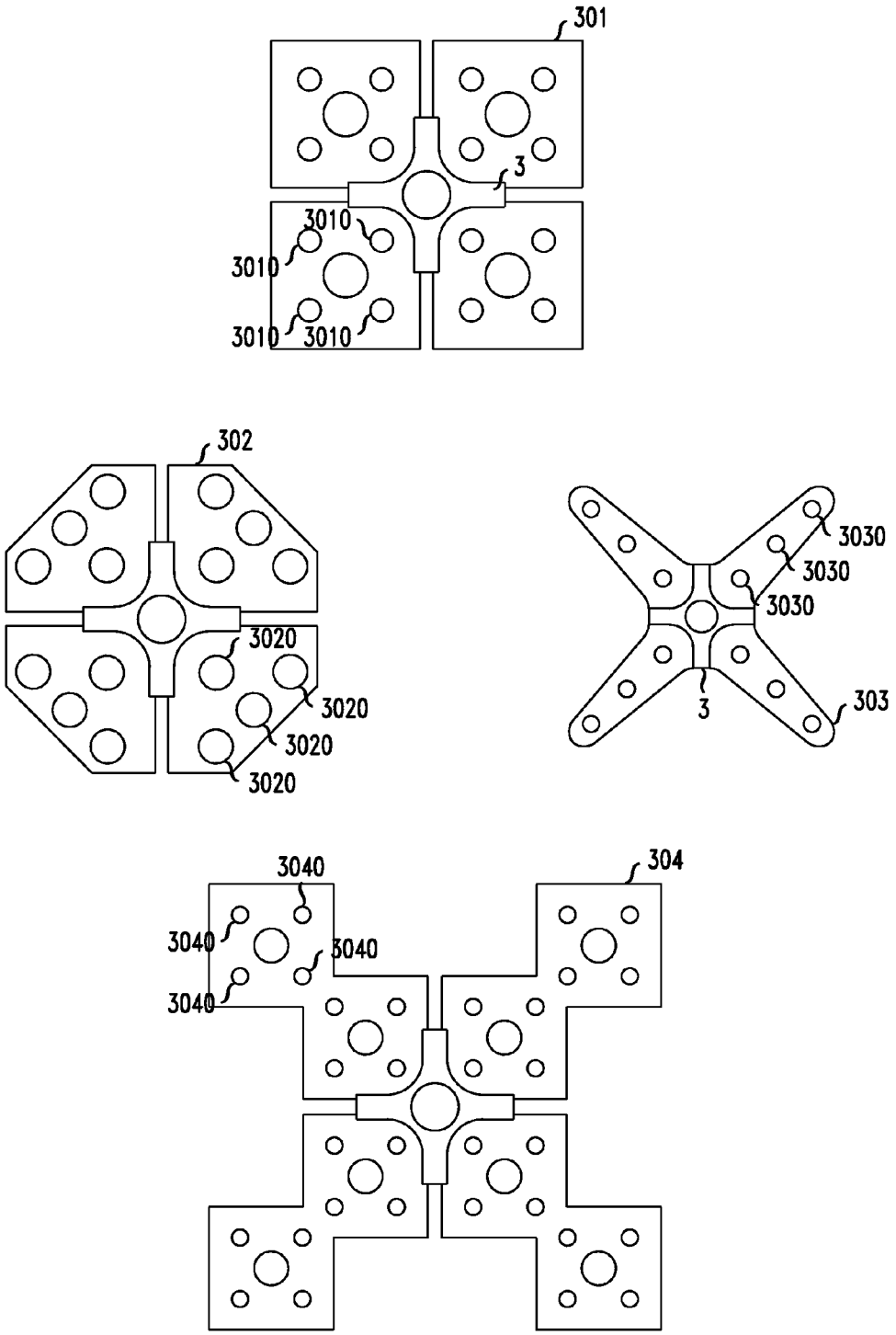
FIG. 3 depicts exemplary antenna elements which include differently shaped arm portions and a plurality of slots according to embodiments of the invention.

Referring to FIG. 3, there is depicted antenna elements 301, 302, 303, 304 each having differently shaped arm portions. Further, in the embodiments shown in FIG. 3, each arm portion of a given antenna element may be configured to comprise a plurality of slots in a volume (three-dimensional) pattern. For example, element 301 comprises slots 3010, element 302 slots 3020, element 303 slots 3030 and element 304 slots 3040.

In one embodiment of the invention, each arm portion of each element 301, 302, 303, 304 may be further configured with the plurality of slots arranged in a fractal pattern. Yet further, each arm portion may be further configured with the plurality of slots arranged in a Sierpinski carpet pattern.

Figure 4:
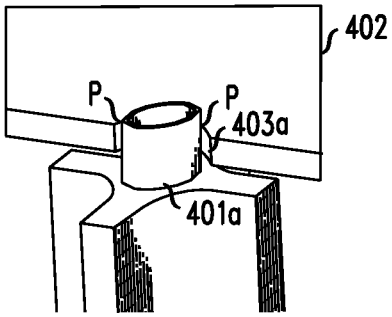
FIG. 4 depicts a number of different methods for connecting a shaped end portion of an antenna element to a chassis according to embodiments of the invention.
Figure 4:
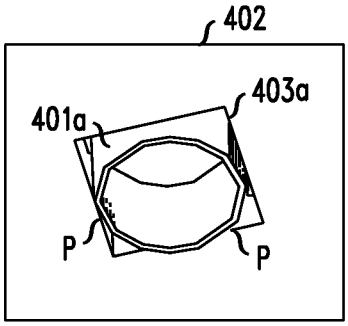
Figure 4:
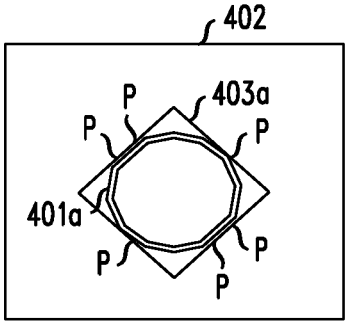

FIG. 4 depicts a number of different methods for connecting a shaped end 401*a* portion to a chassis, for example. In an embodiment of the invention the shaped end portion 401*a* may be point connected to a shaped receptacle section 403*a* through 403*c* of a chassis 402. The shaped receptacle section may be configured in a number of shapes, including rectangular, triangular, and pentagon, to name just a few of the many possible shapes. In FIG. 4, some of the points of contact created by the connection of the shaped end portion 401*a* with the shaped receptacle section of a chassis receptacle are labeled "P". These points of contact function to secure the shaped end portion 401*a* (and its respective antenna element) to the chassis.

Referring now to FIGS. 5*a* and 5*b*, there are depicted two views of the antenna element 303 shown earlier in FIG. 3. FIG. 5*a* shows a close up or magnified view of the element shown in FIG. 5*b*. From FIGS. 5*a* (and 5*b*), in one embodiment of the invention it can be seen that each of the arm portions 505*a-d* may be configured to receive at least a portion of a connecting cable 502*a*, 502*b* within a connection opening 501*a* through *d*.

FIG. 6 illustrates two sets of drawings 6*a*, 6*b*, 6*c* and 60*a*, 60*b*, 60*c*, respectively illustrating the formation of a shaped antenna element body. The sets of drawings are depicted from two different perspectives, with drawings 60*a*, 60*b*, 60*c* showing a two-dimensional side view while drawings 6*a*, 6*b*, 6*c* showing of a three-dimensional view. The drawings are paired, thus, the view depicted in drawing 6*a* occurs at the same time, and represents the same stage of formation of a shaped element body 600, as the view depicted in drawing 60*a* (but, again, taken from different perspectives); the view depicted in drawing 6*b* occurs at the same time, and represents the same stage of formation of a shaped element body 600, as the view depicted in drawing 60*b*; and the view depicted in drawing 6*c* occurs at the same time, and represents the same stage of formation of a shaped element body 600, as the view depicted in drawing 60*c*.

As mentioned above, a set of drawings 6*a*, 6*b*, 6*c* and 60*a*, 60*b*, 60*c* depicts a particular stage in the formation of a unitary antenna, shaped element body 600 according to one embodiment of the invention. As illustrated in the drawings set forth in FIG. 6, at each view or stage the shape of the shaped element body changes from a previous shape to a current shape. In a first stage represented by views 6*a*, 60*a* a shaped element body is depicted as being initially formed using a deep drawn, progressive die or the like, for example. In an embodiment of the invention, the shaped element 600 body may be formed after repeatedly or iteratively applying a progressive die to a material blank. Subsequently, upon applying the die the element body is enlarged or elongated further in view 6*b*, 60*b* and even further enlarged or elongated until a final shape is formed in stage/view 6*c*, 60*c*.

Referring now to FIG. 7 there is depicted a method for forming an antenna element according to an embodiment of the invention. FIG. 7 depicts views (a) through (h), respectively. While FIG. 6 focused on the formation of the body of the unitary element FIG. 7 focuses on the addition of other features and their respective functions to the element. For example, view (a) depicts a body 600 similar to that shown in FIG. 6, views 6*c*, 60*c*. Thereafter, in one embodiment of the invention a method includes the formation of arm portions 601 in view (b) by one or more methods such as stamping, broaching, or machining, formation of the slots 602 in view (c) and formation of elongated holes 603. Continuing, the method may additionally include the formation of a plurality of connection openings 604, 605, 606 and 607 in views (e) through (h), respectively.

Similar to the description of the antenna elements above, the method may further include formation of the antenna element to operate in a frequency range of 1700 MHz to 2700 MHz or higher. Further, the method may include formation of the slots in a fractal pattern, and formation of the slots in a Sierpinski carpet pattern. In addition, one or more alternative methods may comprise forming the plurality of arm portions in a rectangular-shape, triangle-shape, star-shape and/or fractal-shape. Yet further, an additional method may include comprise forming two or more of the plurality of shaped arm portions in a same shape.

While exemplary embodiments have been shown and described herein, it should be understood that variations of the disclosed embodiments may be made without departing from the spirit and scope of the invention. For example, the shapes, dimensions, configuration, transmission frequencies, and/or electrical lengths of the various components of an antenna element may be varied. Yet further, related methods that provide or form similar antenna elements are explicitly covered by the present invention. That said, the scope of the invention should be determined based on the claims that follow.

We claim:

1. A unitary high band dipole antenna element comprising:

a base portion comprising a shaped central portion and an end portion, the shaped central portion comprising a tubular inner portion that connects to the end portion, the end portion having a polygonal cross-sectional shape and configured to be secured within a receptacle of a chassis; and a plurality of shaped arm portions unitarily formed on a side of the base portion opposite the end portion and configured to transmit and receive RF signals in a high frequency range, each arm portion comprising at least one slot, wherein the unitary high band dipole antenna element comprises a one-piece, unitary high band dipole antenna element.

2. The unitary high band dipole antenna element as in claim 1 wherein each arm portion includes a plurality of slots arranged in a fractal pattern.

3. The unitary high band dipole antenna element as in claim 1 wherein each arm portion includes a plurality of slots arranged in a Sierpinski carpet pattern.

4. The unitary high band dipole antenna element as in claim 1 wherein each arm portion is configured in a shape selected from the group consisting of a rectangular-shaped arm portion, triangle-shaped arm portion, star-shaped arm portion and fractal-shaped arm portion.

5. The unitary high band dipole antenna element as in claim 1 wherein two or more of the plurality of shaped arm portions have a same shape.

6. The unitary high band dipole antenna element of claim 1, wherein the antenna element is configured to operate in a frequency range of 1700 MHz to 2700 MHz.

7. The unitary high band dipole antenna element of claim 1 wherein a first arm portion of the plurality of shaped arm portions includes a first connection opening having a first width and a second opposing arm portion including a second connection opening having a second, smaller width, and a third arm portion including a third connection opening having said first width and a fourth arm portion including a fourth connection opening having said second smaller width.

8. The unitary high band dipole antenna element as in claim 7, wherein each of said first and third connection openings are configured to pass a corresponding one of two corresponding connecting cables therethrough, and each of said second and fourth connection opening are configured to receive a central conductor of a corresponding one of said two connecting cables.

9. A unitary high band dipole antenna element comprising:

a base portion comprising a shaped central portion and an end portion configured to be secured within a receptacle of a chassis, the shaped central portion comprising a tubular inner portion that connects to the end portion; and a plurality of shaped arm portions unitarily formed on a side of the base portion opposite the end portion and configured to transmit and receive RF signals in a high frequency range, each arm portion comprising at least one slot, wherein the unitary high band dipole antenna element comprises a one-piece, unitary high band dipole antenna element.

10. The unitary high band dipole antenna element as in claim 9 wherein each arm portion includes a plurality of slots arranged in a fractal pattern.

11. The unitary high band dipole antenna element as in claim 9 wherein each arm portion includes a plurality of slots arranged in a Sierpinski carpet pattern.

12. The unitary high band dipole antenna element as in claim 9 wherein each arm portion is configured in a shape selected from the group consisting of a rectangular-shaped arm portion, triangle-shaped arm portion, star-shaped arm portion and fractal-shaped arm portion.

13. The unitary high band dipole antenna element as in claim 9 wherein two or more of the plurality of shaped arm portions have a same shape.

14. The unitary high band dipole antenna element as in claim 9 wherein the end portion has a polygonal cross-sectional shape.

15. The unitary high band dipole antenna element of claim 9, wherein the antenna element is configured to operate in a frequency range of 1700 MHz to 2700 MHz.

16. The unitary high band dipole antenna element as defined in claim 9 wherein a first arm portion of the plurality of shaped arm portions includes a first connection opening having a first width and a second opposing arm portion including a second connection opening having a second, smaller width, and a third arm portion including a third connection opening having said first width and a fourth arm portion including a fourth connection opening having said second smaller width.

17. The unitary high band dipole antenna element as in claim 16, wherein each of said first and third connection openings are configured to pass a corresponding one of two corresponding connecting cables therethrough, and each of said second and fourth connection opening are configured to receive a central conductor of a corresponding one of said two connecting cables.

* * * * *